US011486277B2

(12) United States Patent
Buttjer

(10) Patent No.: US 11,486,277 B2
(45) Date of Patent: Nov. 1, 2022

(54) WORK VEHICLE ENGINE WITH SPLIT-CIRCUIT LUBRICATION SYSTEM

(71) Applicant: Deere & Company, Moline, IL (US)

(72) Inventor: Jeffrey Alan Buttjer, Waverly, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/187,057

(22) Filed: Feb. 26, 2021

(65) Prior Publication Data

US 2022/0275736 A1 Sep. 1, 2022

(51) Int. Cl.

| | |
|---|---|
| ***F01M 1/16*** | (2006.01) |
| ***F01M 1/02*** | (2006.01) |
| ***F01M 5/00*** | (2006.01) |
| ***F01M 9/10*** | (2006.01) |
| ***F01M 11/00*** | (2006.01) |

(52) U.S. Cl.

CPC ..... *F01M 1/16* (2013.01); *F01M 1/02* (2013.01); *F01M 5/002* (2013.01); *F01M 9/102* (2013.01); *F01M 9/107* (2013.01); *F01M 9/108* (2013.01); *F01M 11/0004* (2013.01); *F01M 2001/0246* (2013.01); *F01M 2005/004* (2013.01); *F01M 2011/007* (2013.01); *F01M 2011/0033* (2013.01); *F01M 2250/60* (2013.01)

(58) Field of Classification Search

CPC ..... F01M 1/16; F01M 1/02; F01M 5/002; F01M 9/102; F01M 9/107; F01M 9/108; F01M 11/0004; F01M 2001/0246; F01M 2005/004; F01M 2011/0033; F01M 2011/007; F01M 2250/60; F01M 2001/1078; F01M 2001/123; F01M 2011/036; E02F 9/2296

See application file for complete search history.

(56) References Cited

U.S. PATENT DOCUMENTS

| | | | | |
|---|---|---|---|---|
| 4,158,529 | A | 6/1979 | Nonnemacher et al. | |
| 5,421,705 | A | 6/1995 | Benckert | |
| 6,899,070 | B2 * | 5/2005 | Neal | F01M 1/12 123/90.15 |
| 2004/0013541 | A1 * | 1/2004 | Sakakibara | H02K 7/14 417/410.3 |

(Continued)

FOREIGN PATENT DOCUMENTS

EP 0821167 A1 1/1998

*Primary Examiner* — Syed O Hasan

(74) *Attorney, Agent, or Firm* — Klintworth & Rozenblat IP LLP

(57) ABSTRACT

A lubrication system for an internal combustion engine of a work vehicle includes an engine oil sump and a pump unit fluidly connected to the engine oil sump to receive engine oil therefrom. The pump unit, in turn, includes a first oil pump comprising a variable displacement pump, a second oil pump, a drive line mechanically coupled to the first oil pump and the second oil pump that drives each of the pumps, and a manifold that directs engine oil from the engine oil sump to the first and second oil pumps. A first oil circuit is fluidly coupled to the first oil pump to direct a first flow of engine oil to piston spray jets in the engine and a second oil circuit is fluidly coupled to the second oil pump to direct a second flow of engine oil to one or more oiled engine components in the engine.

19 Claims, 4 Drawing Sheets

(56) References Cited

U.S. PATENT DOCUMENTS

| | | | | |
|---|---|---|---|---|
| 2005/0180870 | A1* | 8/2005 | Stanley | F04B 23/06 417/440 |
| 2012/0103289 | A1* | 5/2012 | Kato | F01L 1/3442 123/90.15 |
| 2016/0245399 | A1* | 8/2016 | Watanabe | F16H 61/0276 |
| 2019/0219053 | A1* | 7/2019 | Naganuma | F04B 49/125 |
| 2021/0214921 | A1* | 7/2021 | Jäggle | F15B 11/17 |

* cited by examiner

WORK VEHICLE ENGINE WITH SPLIT-CIRCUIT LUBRICATION SYSTEM

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to a lubrication system for an internal combustion engine and, more particularly, to a split-path lubrication system for such engines.

BACKGROUND OF THE DISCLOSURE

Internal combustion engines include a plurality of moving components, including pistons, crankshaft bearings, camshaft bearings, valves, rocker arms, pushrods, and the like. These components require lubrication to prevent wear thereto and prevent the engine from overheating during operation, which is especially of concern for engines employed in large-scale industrial work vehicles. Engines therefore include a lubrication system that distributes oil through the engine to the various components. The lubrication system utilizes an oil pump to draw engine oil from a sump and circulate the engine oil to the moving components via oil galleries and paths in the engine. Typically, a flow of engine oil is output from the oil pump to a single main oil gallery, with additional oil galleries or paths branching off from the main oil gallery to distribute the oil to the moving components of the engine.

SUMMARY OF THE DISCLOSURE

A lubrication system for an internal combustion engine of a work vehicle is disclosed. The lubrication system includes an engine oil sump and a pump unit fluidly connected to the engine oil sump to receive engine oil therefrom. The pump unit, in turn, includes a first oil pump comprising a variable displacement pump, a second oil pump, a drive line mechanically coupled to the first oil pump and the second oil pump and that drives each of the first oil pump and the second oil pump, and a manifold that directs engine oil from the engine oil sump to the first oil pump and the second oil pump. A first oil circuit is fluidly coupled to the first oil pump to direct a first flow of engine oil to piston spray jets in the internal combustion engine, and a second oil circuit is fluidly coupled to the second oil pump to direct a second flow of engine oil to one or more oiled engine components in the internal combustion engine.

In another implementation, an internal combustion engine for a work vehicle includes an engine block having a plurality of piston-cylinder arrangements and a valve head positioned above the engine block and at least in part containing a valve train. An engine oil sump is positioned below the engine block and a pump unit is fluidly connected to the engine oil sump to receive engine oil therefrom. The pump unit further includes a first oil pump comprising a variable displacement pump, a second oil pump, a drive line mechanically coupled to the first oil pump and the second oil pump and that drives each of the first oil pump and the second oil pump, and a manifold that directs engine oil from the engine oil sump to the first oil pump and the second oil pump. A spray jet oil gallery is fluidly coupled to the first oil pump to direct a first flow of engine oil to piston spray jets in the internal combustion engine, and a main oil gallery is fluidly coupled to the second oil pump to direct a second flow of engine oil to one or more oiled engine components in the internal combustion engine.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
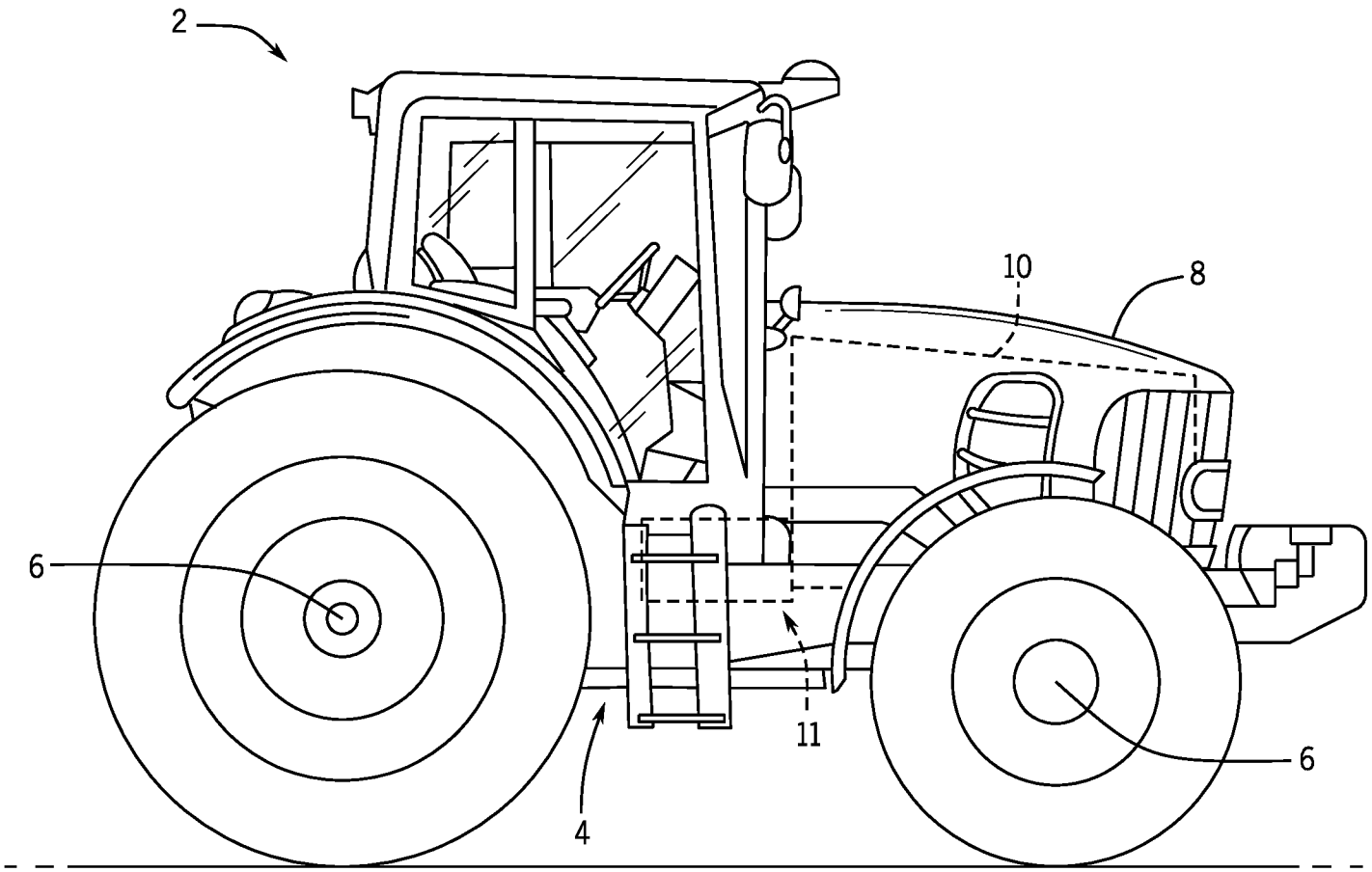
FIG. 1 is a side view of a work vehicle in which embodiments of the present disclosure may be implemented.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth the appended claims.

Overview

As previously noted, internal combustion engines include a lubrication system that distributes oil to various moving components of the engine. Typically, a fixed displacement oil pump draws engine oil from the oil sump of the engine and pumps the engine oil to a main oil gallery. Downstream from the oil pump, the engine oil is then divided amongst additional oil galleries or oil conduits to distribute the oil to the moving components of the engine.

With regard to the various moving engine components, it is recognized that certain components may not require a consistent supply of engine oil thereto. One such component is spray jets in the engine that function to spray oil onto the pistons to provide lubrication thereto. Operation of these piston spray jets to lubricate the pistons is not necessary right at start-up of the engine. Additionally, the amount of oil sprayed onto the pistons by the spray jets may also be reduced during other certain modes of engine operation, such as during operation in a "sleep mode" where the engine runs at a lower rpm for a sustained period of time.

With existing lubrication system designs, the use of a single, fixed displacement oil pump that provides a flow of engine oil to the main oil gallery that is then divided and circulated to individual components does not allow for differentiation in the engine oil supplied to specific components in the engine. Thus, as in the example of the piston spray jets, the oil supplied to the spray jets cannot be differentiated from the oil supplied to the remaining components, even if the engine is in a start-up mode or a sleep mode of operation. This inability of the lubrication system to differentiate the flow of engine oil to the piston spray jets can have a number of drawbacks associated therewith. First, by providing a flow of engine oil to the piston spray jets when it is not required, unnecessary power may be consumed by the spray jets and the oil pump. Second, by providing a flow of engine oil to the piston spray jets when it is not required, the time that it takes to reach a desired oil pressure for operating the other components in the engine may be increased. That is, it may take longer to reach a required oil pressure for a fuel pump in the engine, for example, if a portion of the engine oil is being unnecessarily divided off and provided to the piston spray jets.

To provide for a more efficient circulation of engine oil to the moving components in the engine, including reducing a time to pressure for components and selectively cutting-off a flow of engine oil to certain components, an internal combustion engine and associated split-circuit lubrication system are provided that are suitable for use in industrial-scale work vehicles. Specifically, a split-circuit lubrication system is provided that uses two oil pumps to direct flows of engine oil along two distinct oil paths or circuits in the engine. A pump unit in the engine includes a first oil pump that draws oil from the sump and directs a flow of engine oil along a first oil circuit that is fluidly connected to the piston spray jets and a second oil pump that draws oil from the sump and directs a flow of engine oil along a second oil circuit that is fluidly connected to the other moving components of the engine that require pressure-fed oil to be provided thereto. These moving components may include crankshaft bearings (main bearings and big end and small end bearings on the connecting rods), a fuel pump, auxiliary ports, an oil control valve, an auxiliary drive, turbochargers, rocker shaft and rocker arm bearings, and a camshaft, for example.

In an embodiment, the first oil pump is provided as a variable displacement pump that may be selectively operated to vary the flow of engine oil provided to the first oil circuit. During periods where the piston spray jets are turned off or where the amount of oil sprayed thereby is reduced, the variable displacement pump may be operated to reduce or turn off the flow of engine oil to the piston spray jets. An engine control unit may be operably connected to the variable displacement pump to control operation thereof, such as via controlling an actuator that translates within a linear actuator port of the pump to adjust a flow rate of engine oil generated by the variable displacement pump.

For directing oil from the sump to the first and second oil pumps, the pump unit includes a manifold. The manifold includes a first intake that is fluidly connected to the sump via a first pick-up tube and that directs engine oil from the sump to the first oil pump, and a second intake fluidly connected to the sump via a second pick-up tube and that directs engine oil from the sump to the second oil pump. Engine oil may thus be separately provided to each of the first oil pump and the second oil pump to enable the lubrication system to operate as a split-circuit system.

In one implementation, the lubrication system further includes a pressure regulating valve in the second oil circuit. The pressure regulating valve is operable in an open and closed position to control oil pressure in the second oil circuit, with the pressure regulating valve being actuated to the open position when oil pressure in the second oil circuit meets a desired pressure level. With the pressure regulating valve in the open position, engine oil is routed from the second oil circuit back to the second intake of the manifold, so that engine oil may be re-circulated directly in the second oil circuit without having to be dumped into the engine oil sump.

An example embodiment of an internal combustion engine having a split-circuit lubrication system will now be described in conjunction with FIGS. 1-4 according to this disclosure. By way of non-limiting example, the following describes the engine as having a specified list of moving components to which pressure-fed oil is provided by the split-circuit lubrication system. The following example notwithstanding, internal combustion engines with only some of the described components, or other components not set forth herein, would also benefit from a split-circuit lubrication system of the invention being incorporated therein according to aspects of the invention. It is therefore recognized that aspects of the invention are not meant to be limited only to the specific embodiment described hereafter.

Example Embodiment(s) of a Split-Circuit Lubrication System for a Work Vehicle Engine Referring initially to FIG. 1, a work vehicle 2 is shown that can implement embodiments of the invention. In the illustrated example, the work vehicle 2 is depicted as an agricultural tractor. It will be understood, however, that other configurations may be possible, including configurations with the vehicle 2 as a different kind of tractor, a harvester, a log skidder, a grader, or one of various other work vehicle types. The work vehicle 2 includes a chassis or frame 4 carried on front and rear wheels 6. Positioned on a forward end region of the chassis 4 is a casing 8 within which is located an internal combustion engine 10. The engine 10 provides power via an associated powertrain 11 to an output member (e.g., an output shaft, not shown) that, in turn, transmits an output power to, for example, a rear or front axle of the vehicle 2 to provide propulsion and/or to a power take-off shaft for powering an implement that is supported on the vehicle 2 or that is supported on a separate vehicle.

Figure 2:
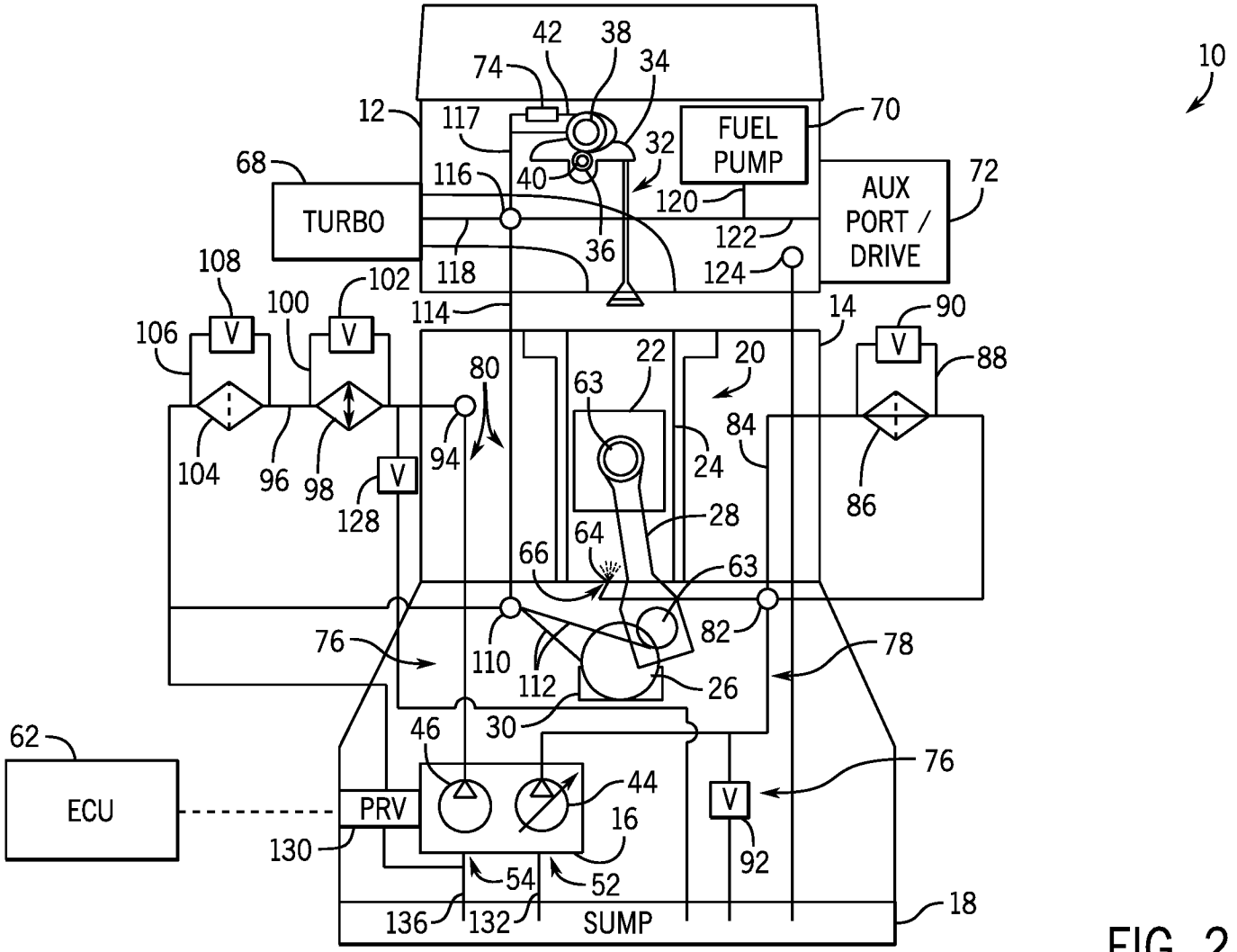
FIG. 2 is a schematic diagram of an internal combustion engine having a split-circuit lubrication system incorporated therein in accordance with an embodiment.

With reference now to FIG. 2, the internal combustion engine 10 is illustrated in further detail in accordance with an embodiment. The engine 10 may be a gasoline or diesel engine and may be of any size, have any number cylinders, and be of any configuration. The engine 10 includes a head 12, an engine block 14, an oil pump unit 16, and an oil sump 18.

The engine block 14 includes a series of piston-cylinder arrangements 20 that may be provided in any configuration such as in-line, opposed or V-type. Pistons 22 reciprocate within combustion cylinders 24 to drive a crankshaft 26 that provides a rotary output. Connecting rods 28 connect the pistons 22 with the crankshaft 26, with a plurality of main bearings 30 holding the crankshaft 26 in place and allowing the crankshaft to rotate within the engine block 14.

The head 12 is positioned over the engine block 14 and includes a valve train 32 therein that admits intake air and permits the discharge of exhaust air from the combustion cylinders 24 of the piston-cylinder arrangements 20. A set of rocker arms 34 mounted on a rocker shaft 36 in or adjacent the head 12 provides for opening and closing the valves in the valve train 32. In one embodiment, the rocker arms 34 actuate valves in the valve train 32 is direct response to rotation of a camshaft 38 (when the camshaft 38 is an overhead camshaft), or alternatively the rocker arms 34 may be actuated by movement of pushrods (not shown) that may be driven by the camshaft 38 (when the camshaft 38 is located in the engine block 14). The rocker arms 34 (and pushrods) may include rocker arm bearings 40 that provide for rotation thereof, while camshaft bearings 42 are provided to support the camshaft 38 and allow the camshaft 38 to spin and thereby control actuation of the valves in the valve train 32.

The oil pump unit 16 may be mounted near a bottom of the engine, such as to a bedplate of the engine 10 for example. The oil pump unit 16 includes a pair of oil pumps therein, i.e., a first oil pump 44 and a second oil pump 46, that draw engine oil from the oil sump 18 to distribute the oil throughout the engine 10, via oil galleries and lines provided in the engine 10, as will be explained in more detail below. The first and second oil pumps 44, 46 function to circulate engine oil to moving components in the engine 10 to reduce wear on the components and provide cooling to the components to reduce the operating temperature thereof.

Figure 3:
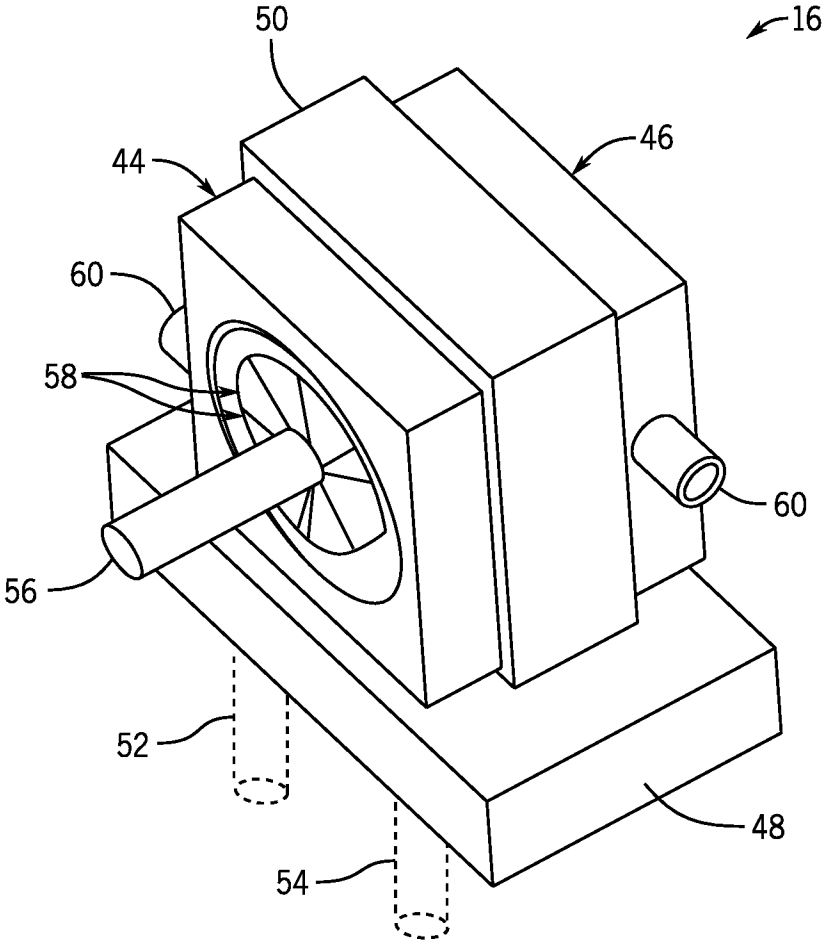
FIG. 3 is a perspective view of an oil pump unit included in the split-circuit lubrication system of FIG. 2.

A structure of the oil pump unit 16 is illustrated in more detail in FIG. 3 according to one embodiment. The oil pump unit 16 is structured as a self-contained pump unit, with the first oil pump 44 and second oil pump 46 mounted on a common mounting plate 48. A manifold 50 is also included in the oil pump unit 16 and is positioned on the mounting plate 48, with the manifold 50 positioned between the first oil pump 44 and the second oil pump 46 in one implementation. The manifold 50 may include first and second intakes 52, 54 that direct oil from the oil sump 18 to the first oil pump 44 and the second oil pump 46, respectively. Each of the first oil pump 44 and the second oil pump 46 are driven by a common drive line 56 (i.e., an oil pump intermediate shaft) that connects the oil pump unit 16 to the camshaft 38 (or a distributor, in an alternate embodiment). When the engine is running, gearing transfers power from the rotating camshaft 38 (or distributor) to the drive line 56 to rotate the drive line and drive the first oil pump 44 and the second oil pump 46.

According to an embodiment, the first oil pump 44 is provided as a variable displacement pump, while the second oil pump 46 is provided as a fixed displacement pump. The first oil pump 44 may therefore be configured as an axial piston pump, according to one example, that includes several pistons 58 arranged parallel to each other and rotating around a central shaft (i.e., drive line 56). Linear actuator ports 60 may be provided on the first oil pump 44 into which an actuator member (not shown) may be inserted, with the actuator member acting on the pistons 58 to cause movement thereof and vary the stroke of the pistons 58. A rotary valve (not shown) alternately connects each piston 58 to the oil supply and delivery lines of the first oil pump 44 such that, by controlling movement of the actuator member, the stroke of the pistons 58 can be varied continuously and correspondingly adjust the output flow rate of the first oil pump 44. While the first oil pump 44 is described above as an axial piston pump, it is recognized that the first oil pump 44 may be any of a number of types of variable displacement pumps that functions to provide a controlled output flow of engine oil.

As shown in FIG. 2, the engine includes an engine control unit 62 configured to control various operational aspects of the engine 10. The engine control unit 62 may control a series of actuators in the engine 10 to ensure optimal engine performance, including controlling an air-fuel mixture, ignition timing, and idle speed in the engine 10, for example. The engine control unit 62 may also be configured to control operation of the first oil pump 44, with a variable flow output from the first oil pump 44 achieved via electronic displacement control of the pump by the engine control unit 62. The engine control unit 62 may, for example, control movement of actuators that engage the linear actuator ports 60 to control and adjust the output flow rate of the first oil pump 44.

As previously indicated, the oil pump unit 16 operates to circulate engine oil to moving components in the engine 10 to provide lubrication and cooling thereto. Numerous components that may receive engine oil from the oil pump unit 16 to provide lubrication and cooling thereto will now be described below, with reference again being made to FIG. 2 to provide such description.

Initially, and as previously described, bearings 30, 42 are provided on each of the crankshaft 26 and the camshaft 38 to provide support thereto and allow the respective shafts to rotate. The main bearings 30 on the crankshaft 26 may be configured as plain or journal bearings and may contain a groove formed therein through which oil enters to lubricate the main bearings 30, while the camshaft bearings 42 may be configured as bushing-type or split-shell type bearings. Other bearings associated with operation of the crankshaft 26 may also be provided, including connecting rod bearings 63 in the form of big end bearings and small end bearings. For the bearings described above, oil is pressure-fed thereto to provide lubrication and cooling to the bearings.

The rocker arms 34 may also include rocker arm bearings 40 therein that provide for rotation of the rocker arms 34. In one example, a roller-type rocker arm may use needle bearings to provide for rotation thereof. Oil may be pressure-fed to the rocker arm bearings 40 through the rocker shaft 36, which is configured as a hollow shaft having holes on a bottom side thereof, such that oil flows through the rocker shaft 36 and then out through the holes to supply oil onto the rocker arm bearings 40 (i.e., oil may drip or spray out from the rocker arms 34 onto the bearings).

To provide for lubrication and cooling of the pistons 22 during reciprocation, piston spray jets 64 are provided in the engine 10. The piston spray jets 64 are positioned/inserted into a hole 66 in each of the combustion cylinders 24 and sit in a spotface at the bottom of the combustion cylinder 24. Oil is pressure-fed to the piston spray jets 64, which then shoot oil up underneath the pistons 22 to provide lubrication and cooling thereto, to thereby control the maximum piston temperature and prevent premature piston wear and engine damage.

According to one implementation, the engine 10 may be a turbo-charged diesel engine that includes a turbocharger 68. The turbocharger 68 operates to take in exhaust from the engine 10 to turn a turbine (not shown) included therein, with the turbine in turn being mechanically coupled to a compressor (not shown) that compresses fresh air that is then pushed into the combustion cylinders 24 in the piston-cylinder arrangements 20, allowing the engine 10 to burn more fuel to produce more power. In operation, oil is pressure-fed to the turbocharger 68 to provide lubrication and cooling to the moving components therein (e.g., components in the turbine and compressor).

In still additional implementations, a fuel pump, one or more auxiliary ports or drives, and oil control valves may also be included in the engine 10 and receive pressure-fed oil to provide lubrication and cooling to these components. The fuel pump, auxiliary ports or drives, and oil control valves are generally indicated at 70, 72, 74, respectively, in FIG. 2, and may operate in a known manner.

To circulate engine oil to the plurality of moving engine components described above, a split-circuit lubrication system 76 is provided for the engine 10. That is, a lubrication system 76 having separate oil circuits is included in the engine 10 to direct distinct flows of engine oil to different components in the engine 10. The lubrication system 76 may be defined as including the oil sump 18, the oil pump unit 16 (first oil pump 44 and second oil pump 46), and a first oil circuit 78 and second oil circuit 80 that may each include, in turn, oil galleries and oil paths through which a flow of engine oil is provided to specific components. As explained further below, the lubrication system 76 is configured such that the first oil pump 44 therein operates to provide a flow of engine oil to the first oil circuit 78, with oil in the first oil circuit 78 being pressure-fed to the piston spray jets 64, while the second oil pump 46 operates to provide a flow of engine oil to the second oil circuit 80, with oil in the second oil circuit 80 being pressure-fed to one or more of the remaining moving components in the engine 10, such as the main bearings 30, rocker arm bearings 40, camshaft bearings 42, turbocharger 68, fuel pump 70, auxiliary ports or drives 72, and oil control valve 74, for example.

As shown in FIG. 2, the first oil pump 44 is connected to the first oil circuit 78 to provide engine oil thereto, with a spray jet gallery 82 of the first oil circuit 78 receiving oil from the first oil pump 44. The spray jet gallery 82 may be formed (i.e., drilled) in the engine block 14 and extend through a portion thereof. An oil line 84 is connected to the spray jet gallery 82, with an oil filter 86 positioned on the oil line 84 to clean the oil prior to it being supplied to the piston spray jets 64. A bypass line 88 having a bypass valve 90 thereon is provided to route oil around the oil filter 86 when the filter is clogged, with the bypass valve 90 opening to route the oil around the oil filter 86. Filtered oil is returned to the spray jet gallery 82 via the oil line 84, with the piston spray jets 64 fluidly connected to the spray jet gallery 82 to receive oil therefrom.

In an embodiment, a blowoff valve 92 is also included in the first oil circuit 78. The blowoff valve 92 may be positioned on the oil line 84 and may be selectively actuated to an open position if the oil pressure in the first oil circuit 78 rises to an unacceptably high level, such as if the first oil circuit 78 is locked-up further upstream. In the open position, engine oil may flow through the blowoff valve 92 and be returned directly to the oil sump 18, thereby relieving pressure in the first oil circuit 78.

As further shown in FIG. 2, the second oil pump 46 is connected to the second oil circuit 80 to provide engine oil thereto, with a main gallery 94 of the second oil circuit 80 receiving oil from the second oil pump 46. The main gallery 94 may be formed (i.e., drilled) in the engine block 14 and extend through a portion thereof. An oil line 96 is connected to the main gallery 94, with an oil cooler 98 positioned on the oil line 96 to provide cooling to the oil prior to it being supplied to components in the engine 10. A bypass line 100 having a bypass valve 102 thereon is provided to route oil around the oil cooler 98 when the oil cooler is not operating, with the bypass valve 102 opening to route the oil around the oil cooler 98. After passing through the oil cooler 98, oil flows along the oil line 96 to an oil filter 104 that functions to filter out particulates and clean the oil. A bypass line 106 having a bypass valve 108 thereon is provided to route oil around the oil filter 104 when the filter is clogged, with the bypass valve 108 opening to route the oil around the oil filter 104.

After passing through the oil cooler 98 and oil filter 104, the cooled and filtered oil is returned to a lube gallery 110 of the second oil circuit 80 via the oil line 96, from which the oil is then directed to a plurality of components in the engine 10. The lube gallery 110 may supply oil to a main bearing lube passage 112 for supplying oil to the main bearings 30 and other bearings associated with operation of the crankshaft 26, such as connecting rod bearings 63 (big end bearings and small end bearings). Oil may also flow from lube gallery 110 via an oil line 114 to a head lube gallery 116, which supplies lube oil to bearings 40, 42 for the rocker arm 34 and the camshaft 38 (where the camshaft is an overhead camshaft), respectively, and to the oil control valve 74 associated with the camshaft 38, with oil provided from the head lube gallery 116 along oil lines 117. Additional lines may also extend off of the head lube gallery 116 to provide pressure-fed oil to additional components of the engine 10, including an oil line 118 that provides oil to the turbocharger 68, an oil line 120 that provides oil to the fuel pump 70, and an oil line 122 that provides oil to the auxiliary ports or drives 72 on the engine 10. The oil in the head 12 may be collected at a gallery 124 and then communicated back to oil sump 18 by a drain line 126.

In an embodiment, a blowoff valve 128 is included in the second oil circuit 80. The blowoff valve 128 may be positioned on the oil line 96 and may be selectively actuated to an open position if the oil pressure in the main gallery 94 rises to an unacceptably high level, such as if the second oil circuit 80 is locked-up further upstream. In the open position, engine oil may flow through the blowoff valve 128 and be returned directly to the oil sump 18, thereby relieving pressure in the second oil circuit 80.

In addition to the blowoff valve 128, a pressure regulating valve 130 is also included in the second oil circuit 80 that helps to regulate the oil pressure in the second oil circuit 80. The pressure regulating valve 130 may be selectively actuated to an open position to control the oil pressure in the main gallery 94. In one example, the pressure regulating valve 130 may be actuated by a spring-loaded diaphragm or piston reacting to changes in a feedback pressure to control a valve opening, with the pressure regulating valve 130 being opened enough to maintain a set regulated oil pressure in the second oil circuit 80. When the main gallery oil pressure reaches a desired level, the pressure regulating valve 130 may open, at which time oil can flow through the pressure regulating valve 130. As shown in FIG. 2, oil that flows through the pressure regulating valve 130 is routed directly back into the second oil circuit 80 rather than being dumped back into the oil sump 18, with the engine oil being drawn back into the second intake 54 of the manifold 50 and provided to the second oil pump 46.

Figure 4:
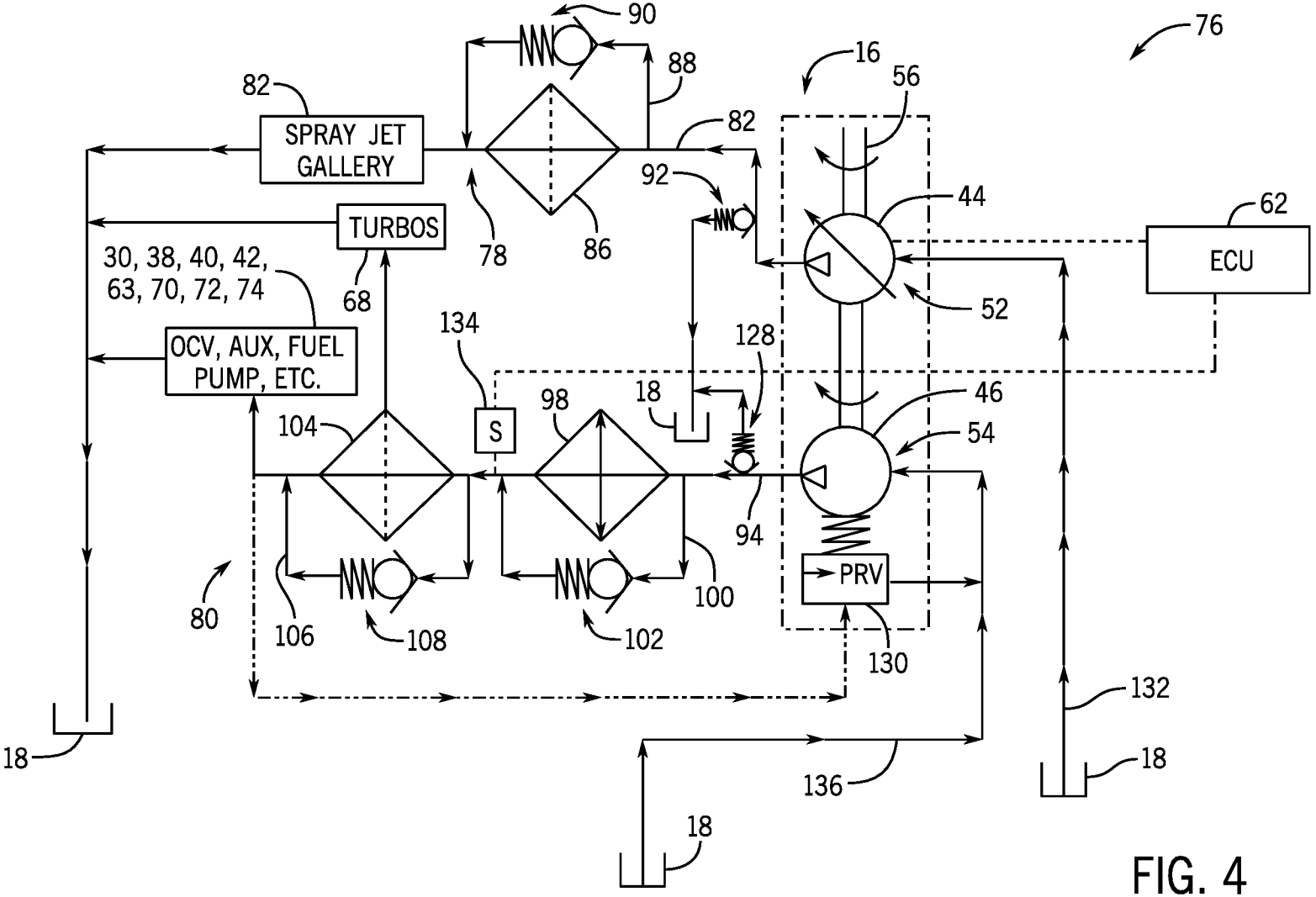
FIG. 4 is a simplified schematic diagram of the split-circuit lubrication system of FIG. 2, showing the split-circuit lubrication system in isolation.

Referring now to FIG. 4, a simplified schematic of the split-circuit lubrication system 76 is provided to better illustrate the operation thereof.

In operation of the lubrication system 76, the first oil pump 44 draws oil up from the oil sump 18 via a pick-up tube 132, with the oil entering the first intake 52 of the manifold 50 and being directed by the manifold 50 to the first oil pump 44. The first oil pump 44 then provides a flow of oil to the first oil circuit 78, with oil flowing along the spray jet gallery 82 of the first oil circuit 78. Oil flows along the spray jet gallery 82 to the oil filter 86 that functions to filter out particulates and clean the oil. After passing through the oil filter 86, engine oil then proceeds along the spray jet gallery 82 to the piston spray jets 64, which operate to shoot oil up underneath the pistons 22 to provide lubrication and cooling thereto. After being sprayed onto the pistons 22, engine oil eventually drains back to the oil sump 18, where the oil may be filtered before being cycled back through the engine 10 again.

Operation of the first oil pump 44 for providing a flow of oil to the piston spray jets 64 is controlled via the engine control unit 62 of engine 10. The engine control unit 62 may control operation of the first oil pump 44 based on a number of operational parameters associated with the engine 10. As one example, the engine control unit 62 may control operation of the first oil pump 44 based on the operating mode of the engine 10. If the engine 10 is in a start-up mode of operation, the engine control unit 62 may turn off the first oil pump 44, such that no engine oil is provided to the first oil circuit 78 and the piston spray jets 64—as no oil is required by the piston spray jets 64 during start-up of the engine 10. Also, if the engine 10 is determined to be in a sleep mode of operation, i.e., where the engine 10 is operating in a low RPM range (e.g., 650 RPM) fora prolonged period of time, the engine control unit 62 may operate the first oil pump 44 to reduce the output flow rate of the first oil pump 44—as less oil is required by the piston spray jets 64 to lubricate the pistons 22 during operation of the engine 10 in sleep mode.

Operation of the first oil pump 44 may be further controlled by the engine control unit 62 based on pressure readings acquired by the engine control unit 62. That is, oil pressure readings may be obtained from the main gallery 94 (e.g., by a main gallery pressure sensor 134, FIG. 4) and provided to the engine control unit 62, from which the engine control unit 62 controls operation of the first oil pump 44. During a normal mode of operation of the engine 10, main gallery oil pressure readings may be provided to the engine control unit 62, and the engine control unit 62 may then control operation of the first oil pump 44 (such as via movement of an actuator member within linear actuator port 60) such that the output flow rate of the first oil pump 44 and oil pressure within the spray jet gallery 82 matches that of the main gallery 94 in the second oil circuit 80.

In operation of the lubrication system 76, the second oil pump 46 draws oil up from the oil sump 18 via a pick-up tube 136, with the oil entering the second intake 54 of the manifold 50 and being directed by the manifold 50 to the second oil pump 46. The second oil pump 46 then provides a flow of oil to the second oil circuit 80, with oil being pumped into the main gallery 94 of the second oil circuit 80. Oil flows along the main gallery 94 to the oil cooler 98 and the oil filter 104 to cool and clean the oil. After passing through the oil cooler 98 and the oil filter 104, engine oil then proceeds along the second oil circuit 80 and is distributed to various moving components of the engine 10. As previously indicated, oil may be distributed to various galleries and lines to provide oil to the main bearings 30, connecting rod bearings 63, rocker arm bearings 40, camshaft bearings 42, camshaft 38, oil control valve 74, turbocharger 68, fuel pump 70, and auxiliary ports or drives 72, as examples. After being provided to the various components, engine oil eventually drains back to the oil sump 18, where the oil may be filtered before being cycled back through the engine 10 again.

As engine oil flows in the second oil circuit 80, the pressure regulating valve 130 regulates the oil pressure in the second oil circuit 80. The pressure regulating valve 130 controls the oil pressure in the main gallery 94 via actuation of a valve element therein (via a spring-loaded diaphragm or piston, for example), with the size of the valve opening in the pressure regulating valve 130 being varied to control a flow of oil therethrough. When the main gallery oil pressure reaches a desired level, the pressure regulating valve 130 opens by an appropriate amount to maintain the oil pressure at that level. Oil that flows through the pressure regulating valve 130 is routed directly back into the second oil circuit 80 rather than being dumped back into the oil sump 18, with the engine oil being drawn back into the second intake 54 of the manifold 50 and provided to the second oil pump 46.

Desirably, embodiments of the split-circuit lubrication system 76 described herein provide distinct circuits by which engine oil may be circulated to components in the engine. A first oil pump 44 is fluidly connected to a first oil circuit 78 to deliver a flow of pressure-fed oil to piston spray jets 64 in the engine, with the first oil pump 44 operating as a variable displacement pump while a second oil pump 46 is fluidly connected to a second oil circuit 80 to deliver a flow of pressure-fed oil to all other moving components in the engine 10 that require oil to operate. The split circuit design allows for a flow of engine oil to be reduced or cut-off from one oil circuit and the component(s) thereon, such as the piston spray jets 64 on the first oil circuit 78, which may be desired when those components are turned off or require only a reduced level of oil. Accordingly, power consumption in the engine may be reduced by selectively operating the variable displacement pump that selectively provides a flow of oil to these components. Additionally, by reducing or cutting-off a flow of oil to one of the oil circuits (i.e., the first oil circuit 78), the time to bring the other oil circuit (i.e., the second oil circuit 80) to pressure can be reduced. Thus, for example, the time to bring a fuel pump 70 to pressure on the second oil circuit 80 may be reduced by a matter of seconds, which is desirable during start-up of the engine 10.

Enumerated Examples

The following examples are provided, which are numbered for ease of reference.

1. A lubrication system for an internal combustion engine for a work vehicle includes an engine oil sump and a pump unit fluidly connected to the engine oil sump to receive engine oil therefrom. The pump unit, in turn, includes a first oil pump comprising a variable displacement pump, a second oil pump, a drive line mechanically coupled to the first oil pump and the second oil pump and that drives each of the first oil pump and the second oil pump, and a manifold that directs engine oil from the engine oil sump to the first oil pump and the second oil pump. A first oil circuit is fluidly coupled to the first oil pump to direct a first flow of engine oil to piston spray jets in the internal combustion engine, and a second oil circuit is fluidly coupled to the second oil pump to direct a second flow of engine oil to one or more oiled engine components in the internal combustion engine.

2. The lubrication system of example 1, wherein the second oil pump comprises a fixed displacement pump.

3. The lubrication system of example 1, further comprising a pressure regulating valve operable in an open and closed position to control oil pressure in the second oil circuit, wherein the pressure regulating valve is actuated to the open position when oil pressure in the second oil circuit meets desired pressure level and wherein, when the pressure regulating valve is in the open position, engine oil is routed from the second oil circuit back to an intake of the manifold without going to the engine oil sump.

4. The lubrication system of example 1, further comprising an engine control unit operably connected to the pump unit to control the first and second flows of engine oil to the first oil circuit and the second oil circuit.

5. The lubrication system of claim 4, wherein the engine control unit operates the first oil pump to reduce or cut-off the first flow of engine oil to the first oil circuit during an engine start-up or operation of the internal combustion engine in a sleep mode.

6. The lubrication system of example 5, wherein a pressurization time of the one or more oiled engine components via the second flow of engine oil on the second oil circuit is reduced when the first flow of engine oil to the first oil circuit is reduced or cut-off.

7. The lubrication system of example 4, wherein each of the first oil pump and the second oil pump includes a linear actuator port configured to receive an actuator therein that adjusts a flow rate of engine oil generated by a respective one of the first oil pump and the second oil pump.

8. The lubrication system of example 4, wherein the second oil circuit includes a main oil gallery, and wherein the engine control unit is configured to receive oil pressure readings in the main oil gallery and control at least one of the first flow and the second flow of engine oil provided by the first oil pump and the second oil pump, respectively, based on the oil pressure readings in the main oil gallery.

9. The lubrication system of example 1, further comprising a blowoff valve positioned in each of the first oil circuit and the second oil circuit and operable in an open and closed position, wherein when the blowoff valve on one or more of the of the first oil circuit and the second oil circuit is in an open position, engine oil is routed back to the engine oil sump.

10. The lubrication system of example 1, wherein the one or more of oiled engine components includes one or more of main bearings, a fuel pump, auxiliary ports, an oil control valve, an auxiliary drive, turbochargers, rocker shaft and rocker arm bearings, and a camshaft and camshaft bearings.

11. The lubrication system of example 1, wherein the manifold includes a first intake that directs engine oil from the engine oil sump to the first oil pump and a second intake that directs engine oil from the engine oil sump to the second oil pump, with the first intake fluidly connected to the engine oil sump via a first pick-up tube and the second intake fluidly connected to the engine oil sump via a second pick-up tube.

12. The lubrication system of example 1, wherein the pump unit further comprises a mounting plate on which each of the first oil pump, the second oil pump, and the manifold are mounted.

13. An internal combustion engine for a work vehicle includes an engine block having a plurality of piston-cylinder arrangements and a valve head positioned above the engine block and at least in part containing a valve train. An engine oil sump is positioned below the engine block and a pump unit is fluidly connected to the engine oil sump to receive engine oil therefrom. The pump unit further includes a first oil pump comprising a variable displacement pump, a second oil pump, a drive line mechanically coupled to the first oil pump and the second oil pump and that drives each of the first oil pump and the second oil pump, and a manifold that directs engine oil from the engine oil sump to the first oil pump and the second oil pump. A spray jet oil gallery is fluidly coupled to the first oil pump to direct a first flow of engine oil to piston spray jets in the internal combustion engine, and a main oil gallery is fluidly coupled to the second oil pump to direct a second flow of engine oil to one or more oiled engine components in the internal combustion engine.

14. The internal combustion engine of example 13, further comprising an engine control unit operably connected to the pump unit, the engine control unit configured to operate the first oil pump to reduce or cut-off the first flow of engine oil to the spray jet oil gallery during an engine start-up or operation of the internal combustion engine in a sleep mode.

15. The internal combustion engine of example 13, further comprising a pressure regulating valve operable in an open and closed position to control oil pressure in the main oil gallery, wherein the pressure regulating valve is actuated to the open position when oil pressure in the main oil gallery meets desired pressure level and wherein, when the pressure regulating valve is in the open position, engine oil is routed from the main oil gallery back to an intake of the manifold without going to the engine oil sump.

CONCLUSION

The foregoing has thus provided a split-circuit lubrication system for an internal combustion engine of a work vehicle that uses a pump unit with two pumps therein, with the first pump generating a flow of oil in a first oil circuit and the second pump generating a flow of oil in a second oil circuit. The first and second pumps are driven by a common drive shaft and receive oil from an oil sump via a manifold in the pump unit. The first oil circuit provides oil to piston spray jets in the engine, while the second oil circuit provides oil to one or more other moving components in the engine that require a supply of pressure-fed oil. The first oil pump is configured as a variable displacement pump that may be selectively operated to vary the flow rate of oil provided to the first oil circuit and to the piston spray jets fluidly connected thereto. Accordingly, during periods when the piston spray jets are turned off or require a reduced amount of oil to lubricate the pistons, the first oil pump may reduce the flow rate of oil provided to the first oil circuit.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A lubrication system for an internal combustion engine of a work vehicle, the lubrication system comprising:
- an engine oil sump;
- a pump unit fluidly connected to the engine oil sump to receive engine oil therefrom, the pump unit comprising:
  - a first oil pump comprising a variable displacement pump;
  - a second oil pump;
  - a drive line mechanically coupled to the first oil pump and the second oil pump and that drives each of the first oil pump and the second oil pump; and
  - a manifold that directs engine oil from the engine oil sump to the first oil pump and the second oil pump;
- a first oil circuit fluidly coupled to the first oil pump to direct a first flow of engine oil to piston spray jets in the internal combustion engine; and
- a second oil circuit fluidly coupled to the second oil pump to direct a second flow of engine oil to one or more oiled engine components in the internal combustion engine;
- wherein each of the first oil pump and the second oil pump comprises a linear actuator port configured to receive an actuator therein that adjusts a flow rate of engine oil generated by a respective one of the first oil pump and the second oil pump.

2. The lubrication system of claim 1, wherein the second oil pump comprises a fixed displacement pump.

3. The lubrication system of claim 1, further comprising a pressure regulating valve operable in an open and closed position to control oil pressure in the second oil circuit, wherein the pressure regulating valve is actuated to the open position when oil pressure in the second oil circuit meets a desired pressure level and wherein, when the pressure regulating valve is in the open position, engine oil is routed from the second oil circuit back to an intake of the manifold without going to the engine oil sump.

4. The lubrication system of claim 1, further comprising an engine control unit operably connected to the pump unit to control the first and second flows of engine oil to the first oil circuit and the second oil circuit.

5. The lubrication system of claim 4, wherein the engine control unit operates the first oil pump to reduce or cut-off the first flow of engine oil to the first oil circuit during an engine start-up or operation of the internal combustion engine in a sleep mode.

6. The lubrication system of claim 5, wherein a pressurization time of the one or more oiled engine components via the second flow of engine oil on the second oil circuit is reduced when the first flow of engine oil to the first oil circuit is reduced or cut-off.

7. The lubrication system of claim 4, wherein the second oil circuit comprises a main oil gallery, and wherein the engine control unit is configured to:
- receive oil pressure readings in the main oil gallery; and
- control at least one of the first flow and the second flow of engine oil provided by the first oil pump and the second oil pump, respectively, based on the oil pressure readings in the main oil gallery.

8. The lubrication system of claim 1, further comprising a blowoff valve positioned in each of the first oil circuit and the second oil circuit and operable in an open and closed position, wherein when the blowoff valve on one or more of the of the first oil circuit and the second oil circuit is in an open position, engine oil is routed back to the engine oil sump.

9. The lubrication system of claim 1, wherein the one or more of oiled engine components comprise one or more of main bearings, a fuel pump, auxiliary ports, an oil control valve, an auxiliary drive, turbochargers, rocker shaft and rocker arm bearings, and a camshaft and camshaft bearings.

10. The lubrication system of claim 1, wherein the manifold comprises:
- a first intake that directs engine oil from the engine oil sump to the first oil pump; and
- a second intake that directs engine oil from the engine oil sump to the second oil pump;
- wherein the first intake is fluidly connected to the engine oil sump via a first pick-up tube and the second intake is fluidly connected to the engine oil sump via a second pick-up tube.

11. The lubrication system of claim 1, wherein the pump unit further comprises a mounting plate on which each of the first oil pump, the second oil pump, and the manifold are mounted.

12. The lubrication system of claim 1, further comprising an oil cooler positioned in the second oil circuit to cool the engine oil prior to delivery to the one or more oiled engine components.

13. An internal combustion engine for a work vehicle comprising:
- an engine block having a plurality of piston-cylinder arrangements;
- a valve head positioned above the engine block and at least in part containing a valve train;
- an engine oil sump positioned below the engine block;
- a pump unit fluidly connected to the engine oil sump to receive engine oil therefrom, the pump unit comprising:
  - a first oil pump comprising a variable displacement pump;
  - a second oil pump;
  - a drive line mechanically coupled to the first oil pump and the second oil pump and that drives each of the first oil pump and the second oil pump; and
  - a manifold that directs engine oil from the engine oil sump to the first oil pump and the second oil pump;
- a spray jet oil gallery fluidly coupled to the first oil pump to direct a first flow of engine oil to piston spray jets in the internal combustion engine; and
- a main oil gallery fluidly coupled to the second oil pump to direct a second flow of engine oil to one or more oiled engine components in the internal combustion engine;
- wherein each of the first oil pump and the second oil pump comprises a linear actuator port configured to receive an actuator therein that adjusts a flow rate of engine oil generated by a respective one of the first oil pump and the second oil pump.

14. The internal combustion engine of claim 13, wherein each of the spray jet oil gallery and the main oil gallery are formed in the engine block.

15. The internal combustion engine of claim 13, wherein the second oil pump comprises a fixed displacement pump.

16. The internal combustion engine of claim 13, further comprising a pressure regulating valve operable in an open and closed position to control oil pressure in the main oil gallery, wherein the pressure regulating valve is actuated to the open position when oil pressure in the main oil gallery meets desired pressure level and wherein, when the pressure regulating valve is in the open position, engine oil is routed from the main oil gallery back to an intake of the manifold without going to the engine oil sump.

17. The internal combustion engine of claim 13, further comprising an engine control unit operably connected to the pump unit to control the first and second flows of engine oil to the spray jet oil gallery and the main oil gallery.

18. The internal combustion engine of claim 17, wherein the engine control unit operates the first oil pump to reduce or cut-off the first flow of engine oil to the spray jet oil gallery during an engine start-up or operation of the internal combustion engine in a sleep mode.

19. The internal combustion engine of claim 17, wherein the engine control unit is configured to:

receive oil pressure readings in the main oil gallery; and control at least one of the first flow and the second flow of engine oil provided by the first oil pump and the second oil pump, respectively, based on the oil pressure readings in the main oil gallery.

* * * * *